US007243990B1

(12) United States Patent
Wahl

(10) Patent No.: US 7,243,990 B1
(45) Date of Patent: Jul. 17, 2007

(54) SUNSHADE APPARATUS

(76) Inventor: Gene Wahl, 322 Moonstone Bay Dr., Oceanside, CA (US) 92057

( * ) Notice: Subject to any disclaimer, the term of this patent is extended or adjusted under 35 U.S.C. 154(b) by 0 days.

(21) Appl. No.: 11/491,723

(22) Filed: Jul. 24, 2006

(51) Int. Cl.
*A47C 7/62* (2006.01)

(52) U.S. Cl. ..... 297/184.15

(58) Field of Classification Search ..... 297/184.15, 297/184.1; 135/121, 139, 142, 143
See application file for complete search history.

(56) References Cited

U.S. PATENT DOCUMENTS

| | | | | |
|---|---|---|---|---|
| 405,038 | A | 6/1889 | Koechling | |
| 840,241 | A | 1/1907 | Nootbaar | |
| 923,596 | A | 6/1909 | Staples | |
| 1,480,286 | A | 1/1924 | Morganstern | |
| 2,660,186 | A | 11/1953 | Marshall et al. | |
| 3,289,982 | A | 12/1966 | Hart, Jr. | |
| 3,434,483 | A | 3/1969 | Topham | |
| 3,533,590 | A | 10/1970 | Swire | |
| 3,904,161 | A | 9/1975 | Scott | |
| 4,063,318 | A | 12/1977 | Nicholson | |
| 4,295,481 | A | 10/1981 | Gee | |
| D265,862 | S | 8/1982 | Caldwell | |
| 4,375,901 | A | 3/1983 | MacDonald | |
| 4,736,921 | A | 4/1988 | Zane et al. | |
| 4,809,724 | A | 3/1989 | Fuser | |
| 4,865,381 | A | 9/1989 | Van Rogue | |
| 5,000,210 | A | 3/1991 | Worthington, Jr. | |
| 5,022,420 | A | 6/1991 | Brim | |
| 5,096,257 | A | 3/1992 | Clark | |
| 5,168,889 | A | 12/1992 | Diestel | |
| 5,203,363 | A | 4/1993 | Kidwell et al. | |
| 5,240,020 | A | 8/1993 | Byers | |
| 5,344,115 | A | 9/1994 | Mayne et al. | |
| 5,441,067 | A * | 8/1995 | James et al. | 135/96 |
| 5,622,345 | A | 4/1997 | Hopkins | |
| 5,797,650 | A | 8/1998 | Gonzalez, Jr. et al. | |
| 5,836,327 | A | 11/1998 | Davis | |
| 5,918,613 | A | 7/1999 | Larson | |
| 5,967,601 | A | 10/1999 | Gillins | |
| 6,349,666 | B1 | 2/2002 | Hastings | |
| 6,371,553 | B1 | 4/2002 | Tang | |
| 6,375,146 | B1 | 4/2002 | Painchaud | |
| 6,588,966 | B2 | 7/2003 | Kane et al. | |
| 6,789,557 | B1 | 9/2004 | Wahl, Jr. | |
| 2002/0125388 | A1 | 9/2002 | Eslick | |

* cited by examiner

*Primary Examiner*—Milton Nelson, Jr.
(74) *Attorney, Agent, or Firm*—Eric Karich

(57) ABSTRACT

A sunshade apparatus for shading a chair has a pair of vertical support legs, a pair of attachment elements, a pair of horizontally extending arms, and a flexible canopy element for shading the chair. Each of the attachment elements is attached to a bottom end of one of the support legs and is adapted for mounting the sunshade apparatus on the chair. Each of the pair of horizontally extending arms is attached to one of the support legs with a hinge. A locking element functions to lock the pair of horizontally extending arms in the extended configuration with respect to the pair of vertical support legs. A folding element joins the horizontally extending arms and folds between a collapsed configuration wherein the arms are adjacent, and a spread configuration wherein the arms are laterally spaced.

9 Claims, 3 Drawing Sheets

48
42
64
40
44
60
62
68
66
22
50
20
40
46
6
50
52
10
20
26
24
4
26
14
12

SUNSHADE APPARATUS

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to sun shades, and more particularly to a sunshade apparatus that is easily portable and can be quickly and easily attached to a portable chair.

2. Description of Related Art

The following art defines the present state of this field: Wahl, Jr., U.S. Pat. No. 6,789,557, teaches a portable and collapsible sunshade apparatus having a novel attachment clip. The universal clip enables any type of sunshade apparatus to be attached to any type of beach chair or lounge chair at any desired height above the occupant of the chair and at any desired angular orientation relative to the chair.

Gillins, U.S. Pat. No. 5,967,601, teaches a sunshade apparatus for use with recreational chairs having a seat back. The sunshade has a rigid support to which upper edge clips and side edge clips are connected for releasable attachment to the seat back upper edge and seat back side edge, respectively. The side edge clips can rotate about the support in a generally horizontal plane, and the side edge clips are constructed in a manner to flex in a generally vertical plane. The upper edge clips have a hook portion to enable the sunshade to hang on the seat back upper edge. A canopy frame, covered with a shade producing cover, is pivotally attached to the support. When not in use, the canopy frame can be pivoted to a collapsed, generally flat configuration with the support.

Brim, U.S. Pat. No. 5,022,420, teaches a shade apparatus for use with a lawn mower. The apparatus includes a plurality of spaced U-shaped mounds for securement to handles of the lawnmower. Support rods pivotally mount at each respective end thereof with first canopy rods wherein the first canopy rods movably receive U-shaped canopy sliders wherein the organization is formable into a conveniently stored organization and easily errected and secured to the associated lawn mower. Further, the invention includes a storage container secured to the canopy wherein the storage container provides a tethered pair of ear protective devices for use in association with a lawn mower.

The above-described references are hereby incorporated by reference in full.

The prior art teaches various forms of sunshades that can be attached to a chair or other structure. However, the prior art does not teach a sunshade apparatus having the unique attachment elements, locking elements, and folding elements described below. The present invention fulfills these needs and provides further related advantages as described in the following summary.

SUMMARY OF THE INVENTION

The present invention teaches certain benefits in construction and use which give rise to the objectives described below.

The present invention provides a sunshade apparatus for shading a chair. The sunshade apparatus includes a pair of vertical support legs, a pair of attachment elements, a pair of horizontally extending arms, and a flexible canopy element for shading the chair. Each of the attachment elements is attached to a bottom end of one of the pair of vertical support legs and is adapted for mounting the sunshade apparatus on the chair. Each of the pair of horizontally extending arms is attached to one of the pair of vertical support legs with a pair of hinges. A locking element functions to lock the pair of horizontally extending arms in the extended configuration with respect to the pair of vertical support legs. A folding element joins the pair of horizontally extending arms and folds between a collapsed configuration wherein the pair of horizontally extending arms are adjacent, and a spread configuration wherein the pair of horizontally extending arms are laterally spaced from each other.

A primary objective of the present invention is to provide a sunshade apparatus having advantages not taught by the prior art.

Another objective is to provide a sunshade apparatus that can be quickly and easily attached to a chair for shading the chair.

A further objective is to provide a sunshade apparatus that can be quickly and easily folded from an extended, spread configuration that is useful for shading the chair, to a folded, collapsed configuration that is contact and easy to transport and store.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a sunshade apparatus 10 for shading a chair 12. While the chair 12 is illustrated as a standard portable chair, the term chair is hereby defined to include any form of chair, lounge, wheelchair, or other device upon which a person might sit, recline, or lounge. The sunshade apparatus 10 may also be driven into sand to be used while the person reclines in the sand.

Figure 1:
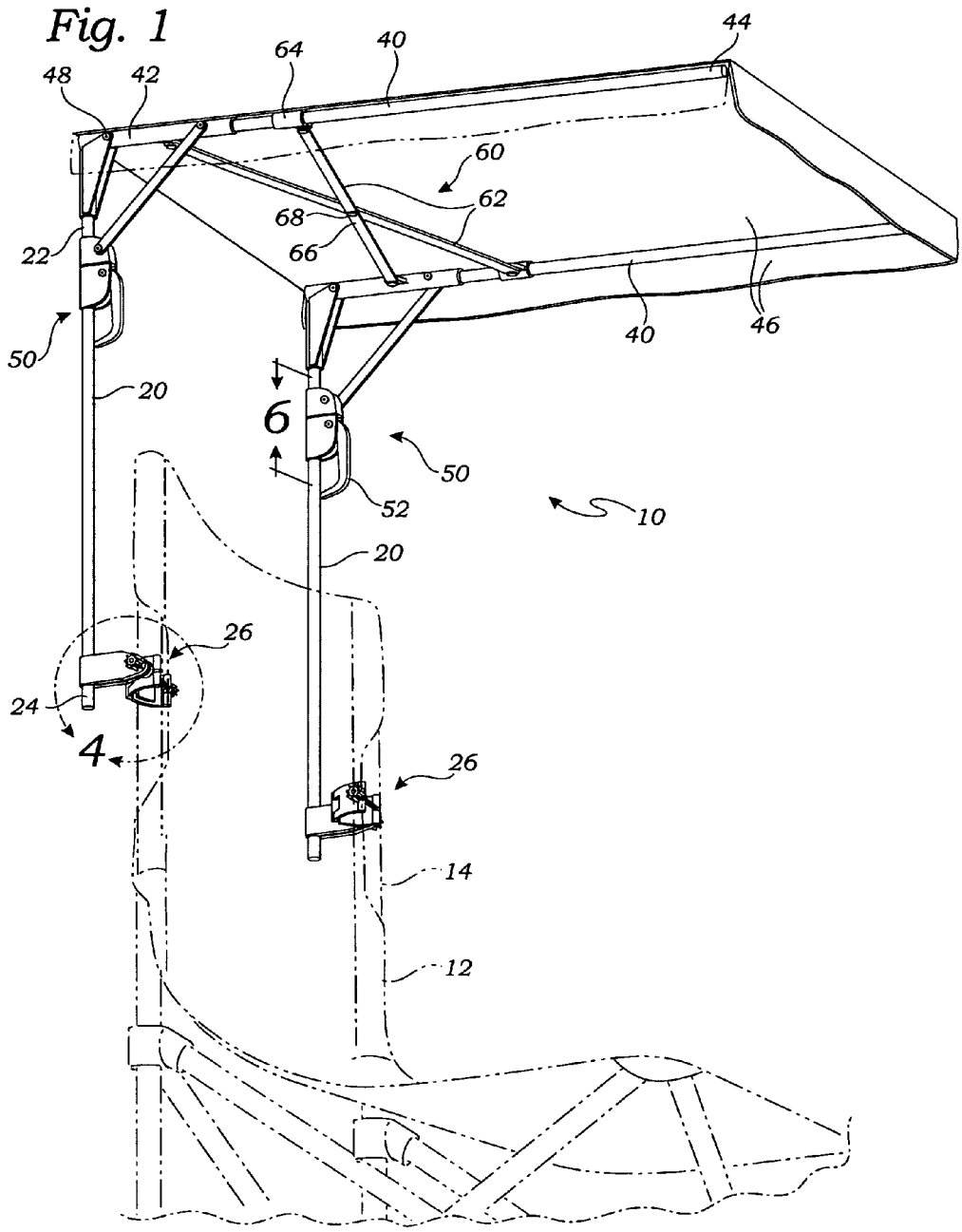
FIG. 1 is an exploded perspective view of a sunshade apparatus according to a preferred embodiment of the present invention, illustrating the sunshade apparatus in an extended and spread configuration, and mounted on a chair.
Figure 2:
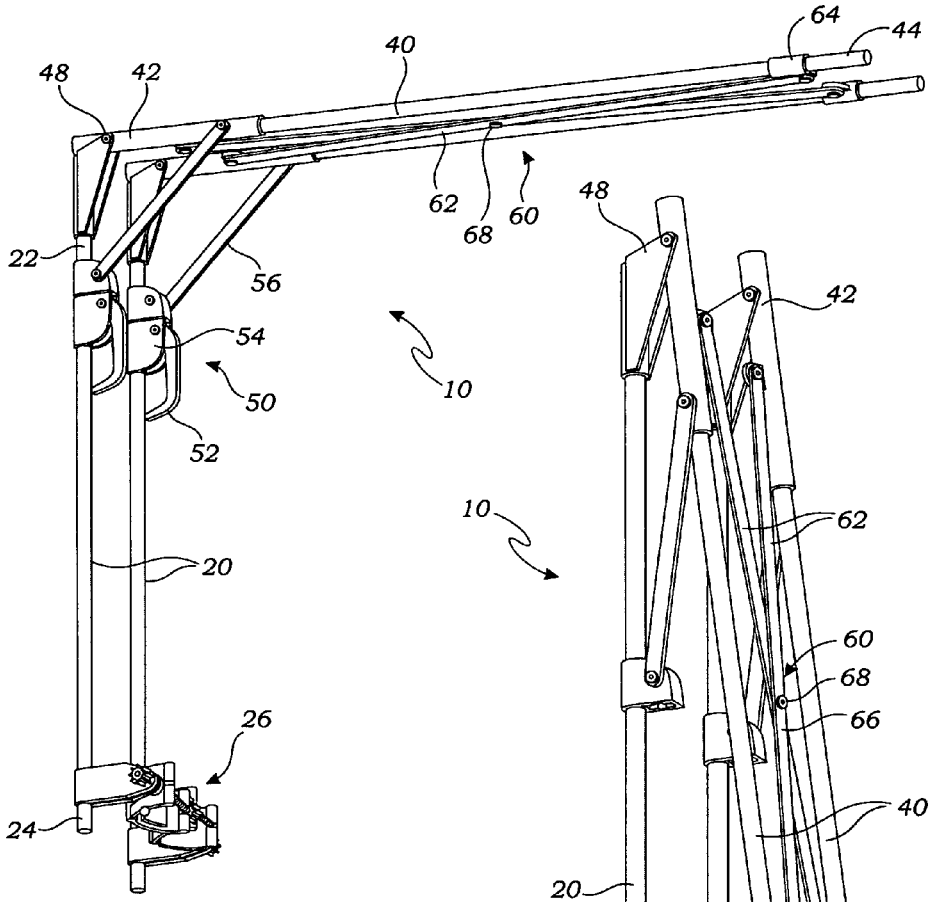
FIG. 2 is a perspective view of the sunshade apparatus of FIG. 1 once the sunshade apparatus has been moved from the spread configuration to a collapsed configuration.
Figure 3:
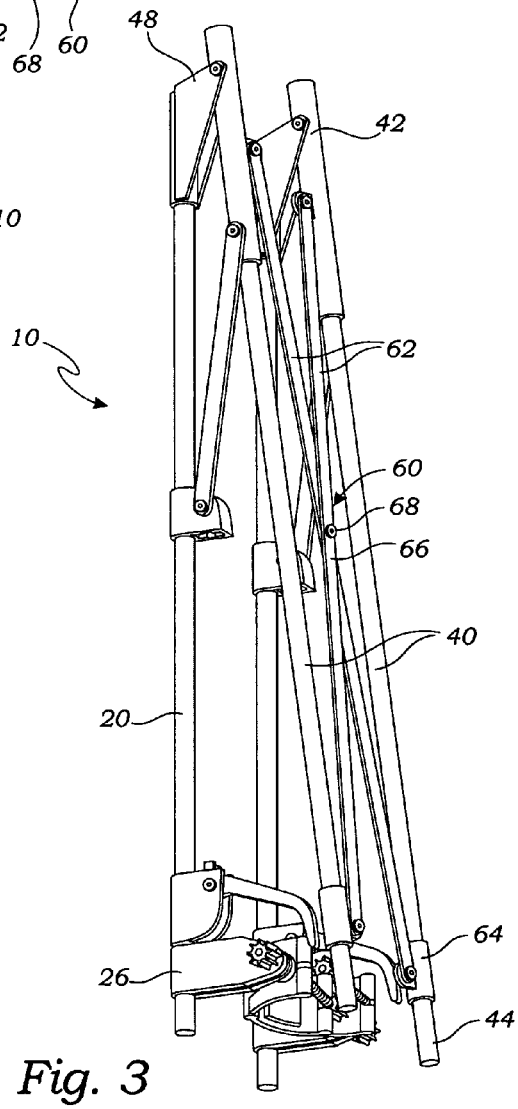
FIG. 3 is a perspective view of the sunshade apparatus of FIG. 2 once the sunshade apparatus has been moved from the extended configuration to a folded configuration.

FIG. 1 is an exploded perspective view of a sunshade apparatus 10 according to a preferred embodiment of the present invention, illustrating the sunshade apparatus 10 in an extended and spread configuration, and mounted on the chair 12. FIG. 2 is a perspective view of the sunshade apparatus 10 of FIG. 1 once the sunshade apparatus 10 has been moved from the spread configuration to a collapsed configuration. FIG. 3 is a perspective view of the sunshade apparatus 10 of FIG. 2 once the sunshade apparatus 10 has been moved from the extended configuration to a folded configuration.

As shown in FIGS. 1–3, the sunshade apparatus 10 includes a pair of vertical support legs 20 that are adapted to be attached to the chair 12, and a pair of horizontally extending arms 40 that extend horizontally for shading the chair 12. Each of the pair of vertical support legs 20 has a top end 22 and a bottom end 24. A pair of attachment elements 26 are attached to the bottom ends 24 of the pair of vertical support legs 20 for mounting the sunshade apparatus 10 on the chair 12.

Figure 4:
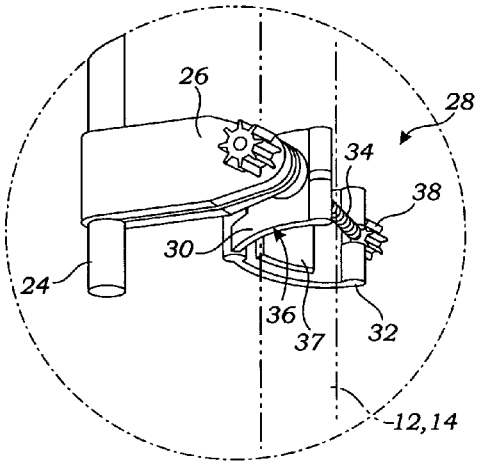
FIG. 4 is an enlarged view of an attachment element of the sunshade apparatus of FIG. 1, illustrating the attachment element in a closed position around a tubular element of the chair.
Figure 5:
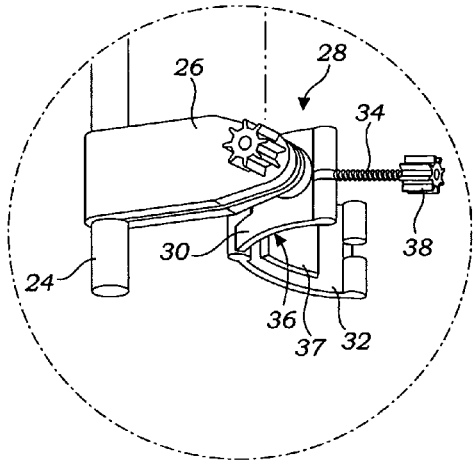
FIG. 5 is an enlarged view of an attachment element of the sunshade apparatus of FIG. 1, illustrating the attachment element in an open position.

FIG. 4 is an enlarged view of an attachment element 26 of the sunshade apparatus 10 of FIG. 1, illustrating the attachment element 26 in a closed position around a tubular element 14 of the chair 12. FIG. 5 is an enlarged view of an attachment element 26 of the sunshade apparatus 10 of FIG. 1, illustrating the attachment element 26 in an open position.

As shown in FIGS. 4 and 5, each of the pair of attachment elements 26 preferably includes a clamp 28 having a first locking portion 30 hingably attached to a second locking portion 32, and a locking screw 34 for clamping the first and second locking portions 30 and 32 around a tubular element 14 of the chair 12. The locking screw 34 is preferably hingably attached to the first locking portion 30 and pivots between a closed position wherein the locking screw 34 lockingly engages the second locking portion 32, and an open position wherein the locking screw 34 is disengaged from the second locking portion 32.

The first locking portion 30 and the second locking portion 32 each preferably include concave inner surfaces 36 and 37 adapted to clamp against the tubular element 14 of the chair 12. The locking screw 34 preferably includes a knob 38 that enables a user to manually tighten each of the pair of attachment elements 26 so that the first locking portion 30 and the second locking portion 32 are tightly clamped around the tubular element 14.

While the preferred embodiment of the attachment elements 26 is described and illustrated in detail, alternative embodiments of the attachment element 26 may also be used in alternative constructions, including various forms of locking screws, spring-loaded clamps, and other alternative or equivalent structures.

As shown in FIGS. 1–3, the sunshade apparatus 10 further includes a pair of horizontally extending arms 40. Each of the pair of horizontally extending arms 40 has a proximal end 42 and a distal end 44. The pair of horizontally extending arms 40 are constructed of an elongate, rigid material, preferably tubular steel, aluminum, or similar material, and extend generally horizontally for the supporting a flexible canopy element 46 attached to the pair of horizontally extending arms 40. As shown in FIG. 1, the flexible canopy element 46 extends between the pair of horizontally extending arms 40 when the pair of horizontally extending arms 40 are in the spread configuration, and functions to shade the chair 12. The flexible canopy element 46 has been removed from the pair of horizontally extending arms 40 in FIGS. 2 and 3, for more clearly illustrating the frame structure of the sunshade apparatus 10.

The pair of horizontally extending arms 40 are attached to the pair of vertical support legs 20 with a pair of hinges 48. Each of the pair of hinges 48 hingably connects the top end 22 of one of the pair of vertical support legs 20 to the proximal end 42 of one of the pair of horizontally extending arms 40 such that the pair of horizontally extending arms 40 can pivot with respect to the pair of vertical support legs 20 between a folded configuration and an extended configuration.

Figure 6:
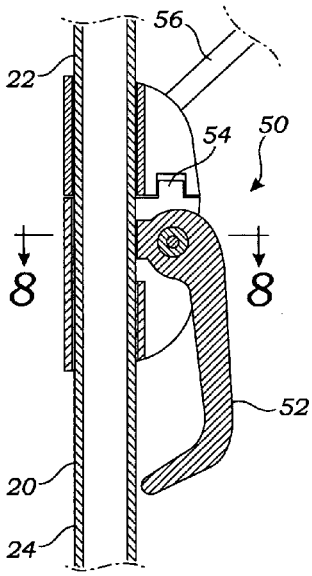
FIG. 6 is a sectional view thereof taken along line 6—6 in FIG. 1, illustrating a locking element having a locking handle, and wherein the locking handle is in a locked position.
Figure 7:
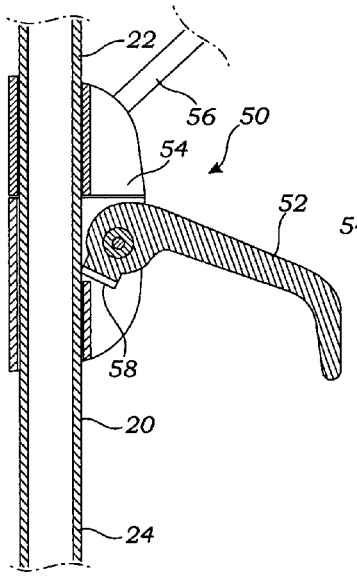
FIG. 7 is a sectional view of the locking element of FIG. 6, wherein the locking handle is in an unlocked position.
Figure 8:
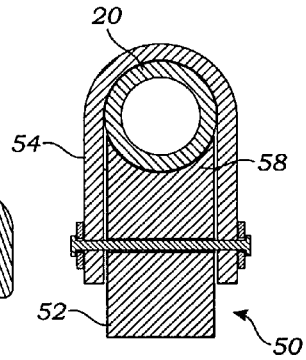
FIG. 8 is a sectional view of the locking element taken along line 8—8 in FIG. 6.

FIGS. 6–8 illustrate a locking element 50 of the sunshade apparatus 10. FIG. 6 is a sectional view of the sunshade apparatus 10 taken along line 6—6 in FIG. 1, illustrating a locking element 50 having a locking handle 52, and wherein the locking handle 52 is in a locked position. FIG. 7 is a sectional view of the locking element 50 of FIG. 6, wherein the locking handle 52 is in an unlocked position. FIG. 8 is a sectional view of the locking element 50 taken along line 8—8 in FIG. 6.

As shown in FIGS. 1, 2, and 6–8, the locking element 50 functions to lock the pair of horizontally extending arms 40 in the extended configuration (as shown in FIG. 2) with respect to the pair of vertical support legs 20. The locking element 50 preferably includes a slider element 54 that is adapted to slidably engage one of the pair of vertical support legs 20. The slider element 54 is pivotally attached to a support bar 56, which is pivotally attached to one of the pair of horizontally extending arms 40, such that moving the slider element 54 towards the top end 22 of the one of the pair of vertical support legs 20 causes the support bar 56 to push the one of the pair of horizontally extending arms 40 from the folded configuration, as shown in FIG. 3, to the extended configuration, as shown in FIGS. 1 and 2.

As shown in FIGS. 6–8, the locking handle 52 is pivotally attached to the slider element 54 such that the locking handle 52 can pivot between a locked position, as shown in FIGS. 6 and 8, and an unlocked position, as shown in FIG. 7. The locking handle 52 preferably has a locking portion 58 that engages the one of the pair of vertical support legs 20 to lock the locking element 50 with respect to the one of the pair of vertical support legs 20. The locking portion 58 preferably frictionally engages the one of the pair of vertical support legs 20.

As shown in FIGS. 1 and 2, the sunshade apparatus 10 further includes a folding element 60 that joins the pair of horizontally extending arms 40. The folding element 60 enables the sunshade apparatus 10 to fold between a collapsed configuration, shown in FIGS. 2 and 3, wherein the pair of horizontally extending arms 40 are adjacent, and a spread configuration, shown in FIG. 1, wherein the pair of horizontally extending arms 40 are laterally spaced from each other.

The folding element 60 preferably includes a pair of folding cross-bars 62 that are each pivotally attached at a first end to one of the pair of horizontally extending arms 40, and each pivotally attached at a second end to a horizontal slider 64 that is adapted to slidably engage one of the pair of horizontally extending arms 40. The pair of folding cross-bars 62 are preferably pivotally connected together in a middle 66 with a pivot pin 68.

While the illustrated embodiment of the folding element 60 is currently preferred, alternative structures may also be devised by those skilled in the art, and should be considered within the scope of the present invention. One alternative structure is illustrated in Wahl, Jr., U.S. Pat. No. 6,789,557, hereby incorporated by reference, and alternative structures should also be included within the scope of the present invention.

Certain terminology is used in the preceding description for convenience only, and is not limiting. Words such as "vertical," "horizontal," "first," "second," "inner," "outer," "upper," "lower," and the like, designate directions in the drawings to which reference is made. The terminology includes the words described above, similar or equivalent words, and derivatives thereof. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A sunshade apparatus for shading a chair, the sunshade apparatus comprising:

a pair of vertical support legs, each of the pair of vertical support legs having a top end and a bottom end;

a pair of attachment elements, each of the attachment elements being attached to the bottom end of one of the pair of vertical support legs, the pair of attachment elements being adapted for mounting the sunshade apparatus on the chair;

a pair of horizontally extending arms, each of the pair of horizontally extending arms having a proximal end and a distal end;

a pair of hinges, each of the pair of hinges hingably connecting the top end of one of the pair of vertical support legs to the proximal end of one of the pair of horizontally extending arms such that the pair of horizontally extending arms can pivot with respect to the pair of vertical support legs between a folded configuration and an extended configuration;

a locking element that functions to lock the pair of horizontally extending arms in the extended configuration with respect to the pair of vertical support legs;

a folding element that joins the pair of horizontally extending arms and folds between a collapsed configuration wherein the pair of horizontally extending arms are adjacent, and a spread configuration wherein the pair of horizontally extending arms are laterally spaced from each other;

a flexible canopy element attached to the pair of horizontally extending arms such that the flexible canopy extends between the pair of horizontally extending arms when the pair of horizontally extending arms are in the spread configurations;

wherein each of the pair of attachment elements includes a clamp having a first locking portion hingably attached to a second locking portion, and a locking screw for clamping the first and second locking portions around a tubular element of the chair, and wherein the locking screw is hingably attached to the first locking portion and pivots between a closed position wherein the locking screw locking engages the second locking portion, and an open position wherein the locking screw is disengaged from the second locking portion.

2. The sunshade apparatus of claim 1, wherein the first locking portion and the second locking portion each include concave inner surfaces adapted to clamp against the tubular element of the chair.

3. The sunshade apparatus of claim 2, wherein the locking screw includes a knob that enables a user to manually tighten each of the pair of attachment elements so that the first locking portion and the second locking portion are tightly clamped around the tubular element.

4. The sunshade apparatus of claim 1, wherein the locking element includes slider element that is adapted to slidably engage one of the pair of vertical support legs, the slider element being pivotally attached to a support bar, which is pivotally attached to one of the pair of horizontally extending arms, such that moving the slider element towards the top end of the one of the pair of vertical support legs causes the support bar to push the one of the pair of horizontally extending arms from the folded configuration to the extended configuration.

5. The sunshade apparatus of claim 4, wherein the slider element of the locking element further includes a locking handle pivotally attached to the slider element such that the locking handle can pivot between a locked position and an unlocked position, the locking handle having a locking portion that engages the one of the pair of vertical support legs to lock the locking element with respect to the one of the pair of vertical support legs.

6. The sunshade apparatus of claim 5, wherein the locking portion frictionally engages the one of the pair of vertical support legs.

7. The sunshade apparatus of claim 1, wherein the folding element includes a pair of folding cross-bars that are each pivotally attached at a first end to one of the pair of horizontally extending arms, and each pivotally attached at a second end to a horizontal slider that is adapted to slidably engage one of the pair of horizontally extending arms.

8. A sunshade apparatus for shading a chair, the sunshade apparatus comprising:

a pair of vertical support legs, each of the pair of vertical support legs having a top end and a bottom end;

a pair of attachment elements, each of the attachment elements being attached to the bottom end of one of the pair of vertical support legs, the pair of attachment elements being adapted for mounting the sunshade apparatus on the chair;

a pair of horizontally extending arms, each of the pair of horizontally extending arms having a proximal end and a distal end;

a pair of hinges, each of the pair of hinges hingably connecting the top end of one of the pair of vertical support legs to the proximal end of one of the pair of horizontally extending arms such that the pair of horizontally extending arms can pivot with respect to the pair of vertical support legs between a folded configuration and an extended configuration;

a locking element that functions to lock the pair of horizontally extending arms in the extended configuration with respect to the pair of vertical support legs;

a folding element that joins the pair of horizontally extending arms and folds between a collapsed configuration wherein the pair of horizontally extending arms are adjacent, and a spread configuration wherein the pair of horizontally extending arms are laterally spaced from each other;

a flexible canopy element attached to the pair of horizontally extending arms such that the flexible canopy extends between the pair of horizontally extending arms when the pair of horizontally extending arms are in the spread configuration; and wherein the folding element includes a pair of folding cross-bars that are each pivotally attached at a first end to one of the pair of horizontally extending arms, and each pivotally attached at a second end to a horizontal slider that is adapted to slidably engage one of the pair of horizontally extending arms, and wherein the pair of folding cross-bars are pivotally connected together in a middle with a pivot pin.

9. A method for shading a chair, the method comprising the steps of:

providing a sunshade apparatus comprising:

a pair of vertical support legs, each of the pair of vertical support legs having a top end and a bottom end;

a pair of attachment elements, each of the attachment elements being attached to the bottom end of one of the pair of vertical support legs, the pair of attachment elements being adapted for mounting the sunshade apparatus on the chair;

a pair of horizontally extending arms, each of the pair of horizontally extending arms having a proximal end and a distal end;

a pair of hinges, each of the pair of hinges hingably connecting the top end of one of the pair of vertical support legs to the proximal end of one of the pair of horizontally extending arms such that the pair of horizontally extending arms can pivot with respect to the pair of vertical support legs between a folded configuration and an extended configuration;

a locking element that functions to lock the pair of horizontally extending arms in the extended configuration with respect to the pair of vertical support legs;

a folding element that joins the pair of horizontally extending arms and folds between a collapsed configuration wherein the pair of horizontally extending arms are adjacent, and a spread configuration wherein the pair of horizontally extending arms are laterally spaced from each other; and a flexible canopy element attached to the pair of horizontally extending arms such that the flexible canopy extends between the pair of horizontally extending arms when the pair of horizontally extending arms are in the spread configuration;

spreading the pair of horizontally extending arms to the spread configuration;

attaching the pair of attachment elements to the chair;

lifting the pair of horizontally extending arms to the extended configuration; and locking the pair of horizontally extending arms in the extended configuration using the locking element.

* * * * *